US007100303B2

(12) United States Patent
Bernon et al.

(10) Patent No.: US 7,100,303 B2
(45) Date of Patent: Sep. 5, 2006

(54) APPARATUS AND METHOD FOR THE HEAT TREATMENT OF LIGNOCELLULOSIC MATERIAL

(75) Inventors: Jean-Pierre Bernon, L'Isle d'Abeau (FR); Bernard Robert, Yssingeaux (FR); Fabrice Robert, Bessamorel (FR); Jacky Drevet, Saint-Just Malmont (FR)

(73) Assignee: PCI Industries Inc., Quebec (CA)

( * ) Notice: Subject to any disclaimer, the term of this patent is extended or adjusted under 35 U.S.C. 154(b) by 56 days.

(21) Appl. No.: 10/299,999

(22) Filed: Nov. 20, 2002
(Under 37 CFR 1.47)

(65) Prior Publication Data

US 2004/0148795 A1 Aug. 5, 2004

(51) Int. Cl.
*F26B 25/06* (2006.01)
*F26B 3/02* (2006.01)

(52) U.S. Cl. ..... 34/225; 34/477; 34/479; 34/487; 34/396; 34/224; 34/232; 34/233

(58) Field of Classification Search ..... 34/479, 34/487, 550, 145, 195, 196, 197, 225, 233, 34/232, 224, 396, 219, 234, 77, 374, 443, 34/467, 474, 475, 476, 477, 478; 110/204, 110/224, 225, 226, 227, 228, 229, 230, 231
See application file for complete search history.

(56) References Cited

U.S. PATENT DOCUMENTS 1,366,225 A 1/1921 Weiss
1,678,559 A 7/1928 Devine
2,295,475 A * 9/1942 Hurxthal ..... 34/213
3,131,034 A 4/1964 Marsh
3,614,074 A * 10/1971 Wellford, Jr. ..... 432/48
4,615,122 A * 10/1986 Sherrod et al. ..... 34/422
5,228,209 A 7/1993 Brunner
5,433,905 A 7/1995 Tisch
5,671,660 A * 9/1997 Moshonas ..... 99/443 C
5,678,324 A 10/1997 Viitaniemi et al.
5,819,436 A 10/1998 Helevirta
5,979,074 A 11/1999 Brunner et al.
6,014,819 A 1/2000 Elder
6,119,364 A 9/2000 Elder
6,259,064 B1 * 7/2001 Wilson ..... 219/400
6,374,513 B1 * 4/2002 Unternhahrer et al. ..... 34/396

FOREIGN PATENT DOCUMENTS

FR 2720969 * 12/1995

* cited by examiner

*Primary Examiner*—Kenneth Rinehart
(74) *Attorney, Agent, or Firm*—Rothwell, Figg, Ernst & Manbeck, P.C.

(57) ABSTRACT

There is provided an apparatus and a method for heat treatment of lignocellulosic material. The apparatus comprises a treatment chamber and devices for circulating and recovering gases from the treatment chamber such as to provide a uniform temperature within the chamber and allow efficient drying of the material. This is achieved by injecting and recovering the gases from at least two sides of the treatment chamber.

17 Claims, 8 Drawing Sheets

APPARATUS AND METHOD FOR THE HEAT TREATMENT OF LIGNOCELLULOSIC MATERIAL

CROSS-REFERENCE TO RELATED APPLICATIONS

This is the first application filed for the present invention.

TECHNICAL FIELD

The present invention relates to apparatus and to a method for carrying out high temperature treatment of lignocellulosic material, such as wood.

BACKGROUND OF THE INVENTION

High temperature treatment of lignocellulosic material, such as wood, makes it possible to reduce their moisture content and improve their stability characteristics.

Various methods and apparatus for carrying out high temperature treatment of lignocellulosic materials are known. FR-A-2,720,969 discloses such a method and a cell for carrying it out. This document discloses drying of the materials, followed by heating in a closed circuit during which the gases released by the material are employed as a fuel, and finally, cooling by injection of water. The closed-circuit heating step disclosed in this document does not make it possible to ensure residual humidity, remaining after the drying step, is completely eliminated. Additionally, the use of the gases released by the material as a fuel involves control of the treatment plant which is difficult to achieve in practice. Finally, injecting water for cooling leads to the material treated splitting or breaking up. The cell disclosed in that document for carrying out the method has corresponding disadvantages, and in practice, it is difficult or even impossible to carry out material treatment inside it. In particular, it is difficult, with this apparatus, to ensure that the gases released are subject to combustion, as proposed in the method, and it is also difficult and dangerous to carry out heating in a closed circuit. U.S. Pat. No. 6,374,513 discloses an apparatus and a method for high temperature disclosure in which delivery channels carry the gases to the treatment chamber on one side, and an induction channel, on the other side of the treatment chamber, recovers the gases to be channeled to a combustion chamber. However, the arrangement of this apparatus, which is further described below, creates a unidirectional flow of gas within the treatment chamber that results in temperature inhomogeneity within the material being treated. While this has utility in certain circumstances, there is a need for an improved apparatus for treating lignocellulosic material.

SUMMARY OF THE INVENTION

The invention discloses a method and apparatus making it possible to overcome these disadvantages. It provides simple, effective, high temperature treatment, preserving the mechanical properties of the material, and is easy to carry out in practice. The apparatus of the invention has a simple and robust structure, and makes it possible to provide effective treatment without the need for complicated adjustments. In particular, the flow of gases within the treatment chamber is substantially uniform and contributes to a more homogenous temperature within the material being treated and a more efficient drying of the material.

One object of the invention is to provide an improved method and apparatus for the treatment of lignocellulosic material.

A further object of one embodiment is to provide an apparatus suitable for high temperature treatment of lignocellulosic material comprising: a treatment chamber of the material; at least one combustion chamber having at least one burner operating in a reducing atmosphere; circulating means for circulating gases from the treatment chamber such that at least part of the gases circulate through the combustion chamber; and gas injection means and recirculation means at least partially enclosing the treatment chamber, the gas injection means being operatively connected and mounted proximate to the recirculation means for coordinated gas injection and removal from the treatment chamber to maintain a uniform temperature within the treatment chamber.

The apparatus gas injection means and recirculation means can take the form of ducts, nozzles, funnels, channels, or any other suitable shape for gas injection or delivery.

The apparatus may include at least one extraction chimney connected to the treatment chamber.

The apparatus may also include fluid injection means for introducing cooling fluids within the treatment chamber.

The apparatus may optionally provide temperature sensors for measuring a temperature externally of said material and a temperature within the material. Further, burners regulation may be provided to facilitate a constant temperature difference between the material and a point externally of the material.

As a further object of an embodiment, there is provided a method for high temperature treatment of lignocellulosic material comprising: providing a treatment chamber having sides, the chamber for receiving a lignocellulosic material for treatment; preheating gas for circulation within the treatment chamber; and circulating gas within the treatment chamber to provide a circulation pattern where at least two sides of the treatment chamber cooperatively discharge and recover gas to maintain a uniform temperature within the treatment chamber.

In a further embodiment of the method, there is provided a step of cooling the circulating gases by using well known cooling methods, such as passive radiation, diffusion, cooling fluids, heat sinks, and the like.

BRIEF DESCRIPTION OF THE DRAWINGS

Further features and advantages of the present invention will become apparent from the following detailed description, taken in combination with the appended drawings.

It will be noted that throughout the appended drawings, like features are identified by like reference numerals.

DETAILED DESCRIPTION OF THE PREFERRED EMBODIMENT

For explanatory purposes, FIG. 1 through 8 will be generally discussed prior to the detailed description of the invention.

Figure 1:
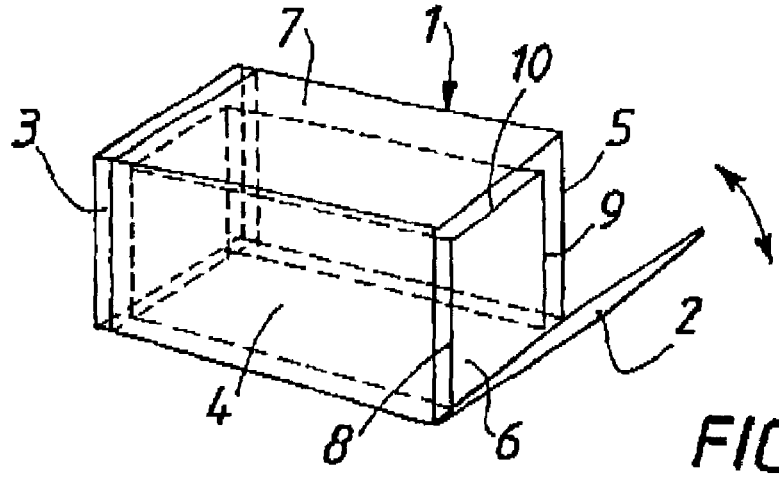
FIG.1 PRIOR ART
FIG. 1 is schematic view of an apparatus for temperature treatment of lignocellulosic material according to the prior art.

FIG. 1 is a diagrammatical view in perspective of an apparatus for high temperature treatment of lignocellulosic material. The treatment apparatus comprises a cell 1, forming a rectangular cross-section tunnel designed to receive the material to be treated. The ends of cell 1 can be closed by means of a door 2 and a base 3. This configuration makes it possible, if needs be, to assemble several cells, for example for treating long or bulky charges. A cell according to the invention can, for example, measure 4.5 meters long, 1.45 meters wide and 2.15 meters high. These dimensions provide a useful treatment volume of some 6 to 10 cubic meters of lignocellulosic material.

Each cell comprises an outer sealed wall, preferably heat-insulated, ensuring mechanical stability of the cell, a treatment chamber with two lateral panels 4, 5, a floor 6 and a ceiling 7. Inside this outer wall, the cell has inner walls, defining a treatment chamber between the two openwork side panels 8, 9, an arched roof 10, and floor 6.

Figure 2:
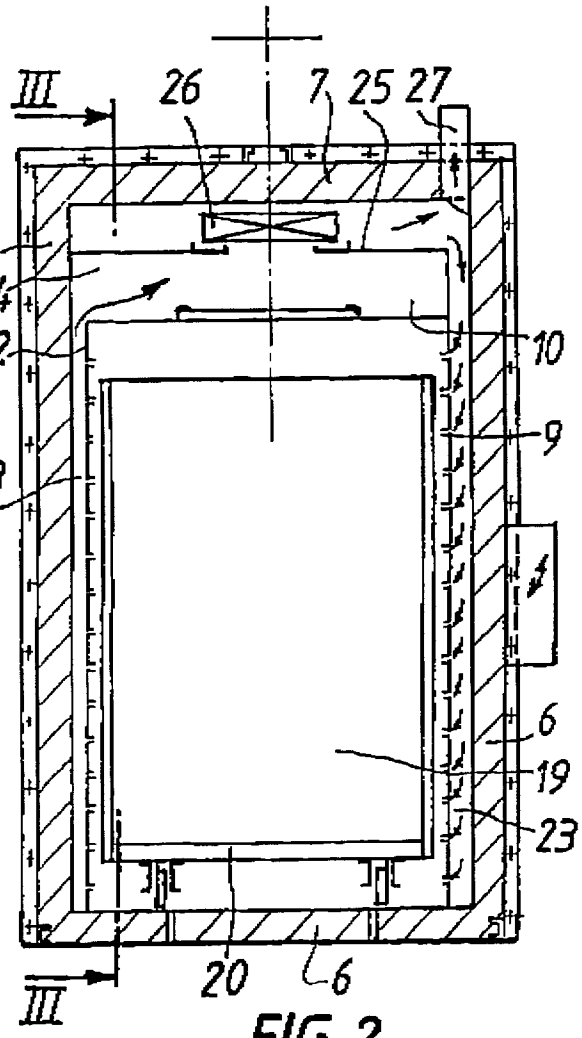
FIG. 2 PRIOR ART
FIG. 2 is a side view in cross-section of the apparatus of FIG. 1.

FIG. 2 is a diagrammatical view in lateral cross section of the apparatus of FIG. 1. In FIG. 2, the elements already described in FIG. 1 can be recognized. Additionally, a charge of the material to be processed 19, introduced into the treatment chamber on a truck or trolley 20 is shown in FIG. 2. On each side of the cell, the lateral panels of an outer wall 4 and 8, (respectively 5 and 9) define a channel 22 (respectively 23), provided for circulation of gases. On the induction side, on the left in FIG. 2, induction channel 22 terminates at an induction chamber 24, defined between the arched roof 10 and a horizontal wall 25 arranged above the latter. A mixing turbine 26, which can be driven by a motor-driven blower located externally of the cell, draws in the gases that are inside induction chamber 24, and discharges them partly into a discharge chimney 27, partly into a delivery chamber 23, and partly towards a combustion chamber which will be described below. The gases in the cell thus circulate from the treatment chamber to induction channel 22 via the openwork side panel 8, then to the induction chamber 24, pass through turbine 26 and are blown into delivery chamber 23, and then towards the treatment chamber through side panel 9.

Figure 3:
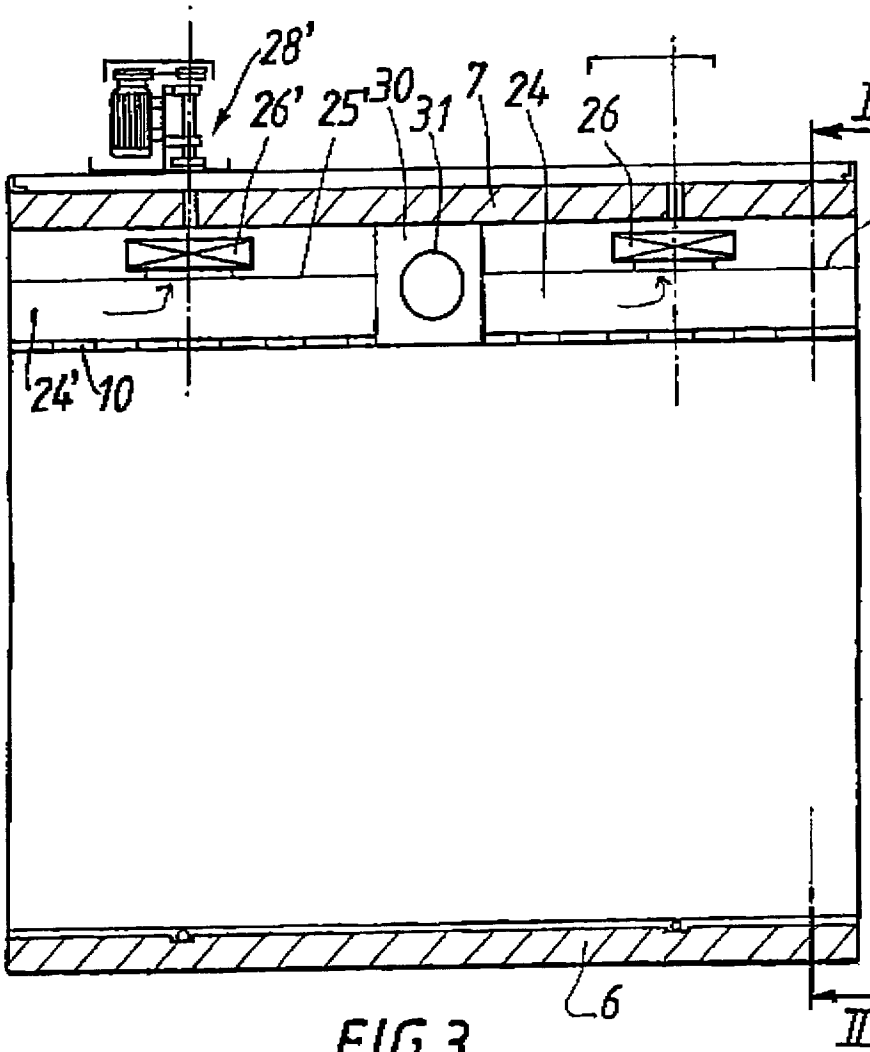
FIG. 3 PRIOR ART
FIG. 3 is a longitudinal cross-section of the apparatus in FIG. 1.

FIG. 3 is a longitudinal cross section of the apparatus in FIG. 1, on a plane III—III of FIG. 2. Charge 19 and truck or trolley 20 are not shown in FIG. 3. FIG. 3 shows the plane II—II of the cross section in FIG. 2. As shown in FIG. 3, induction chamber 24 does not extend over the whole length of the cell: a combustion chamber 30 is provided between arched roof 10 and the ceiling 7; a burner 31 is provided inside chamber 30. In the embodiment of FIGS. 2 and 3, the combustion chamber is arranged close to the middle of the cell, having on each side of the combustion chamber, an induction chamber 24, 24' and a turbine 26, 26'. This configuration ensures that the gases get mixed homogeneously, using turbines of a reasonable size. One could also adopt different configurations, for example using two combustion chambers and one induction chamber with one or several turbines. On FIG. 3, one of the motor-driven blower units 28' has also been shown, driving mixing turbine 26'.

Figure 4:
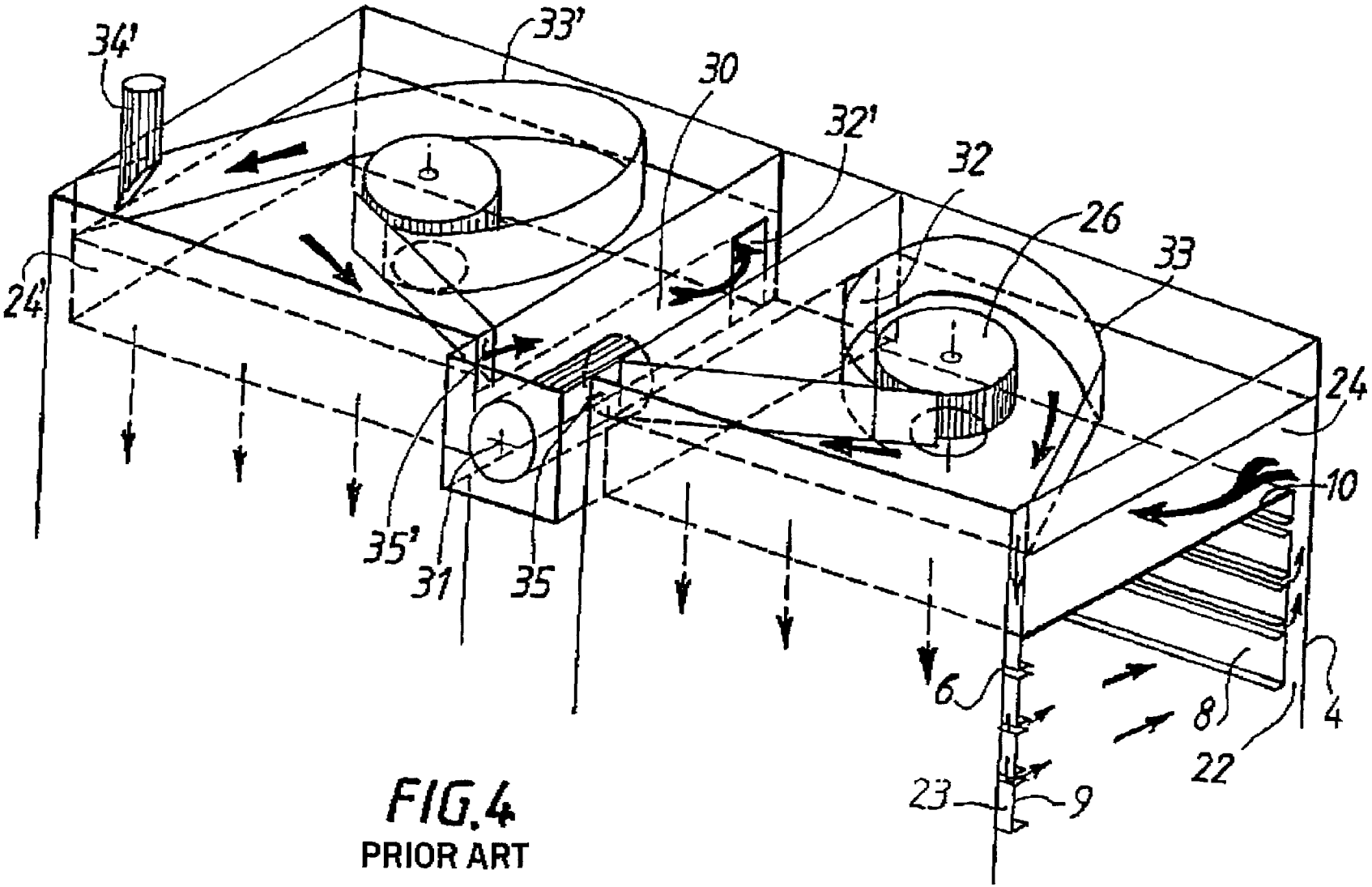
FIG.4 PRIOR ART
FIG. 4 is a top perspective view of the apparatus in FIG. 1, with partial removal to show inside detail.

FIG. 4 is a top view in perspective of the cell. Apart from the elements already described, FIG. 4 shows how combustion chamber 30 extends over the width of the cell and has, at its end opposite the location of burner 31, openings 32, 32', which discharge into the induction chambers 24 and 24'. These openings can advantageously be fitted with one or two regulating shutters making it possible to balance the flow originating from combustion chamber 30 towards induction chambers 24, 24'. FIG. 4 shows the baffles 33, 33' of the mixing turbines 26 and 26', which direct the air blown by the turbines in the direction of delivery channel 23, towards the extraction chimneys—only one of the two chimneys, 34, being shown—and towards openings 35, 35' which discharge into combustion chamber 30 close to burner 31. A humidity sensor is provided in at least one of the extraction chimneys.

Figure 5:
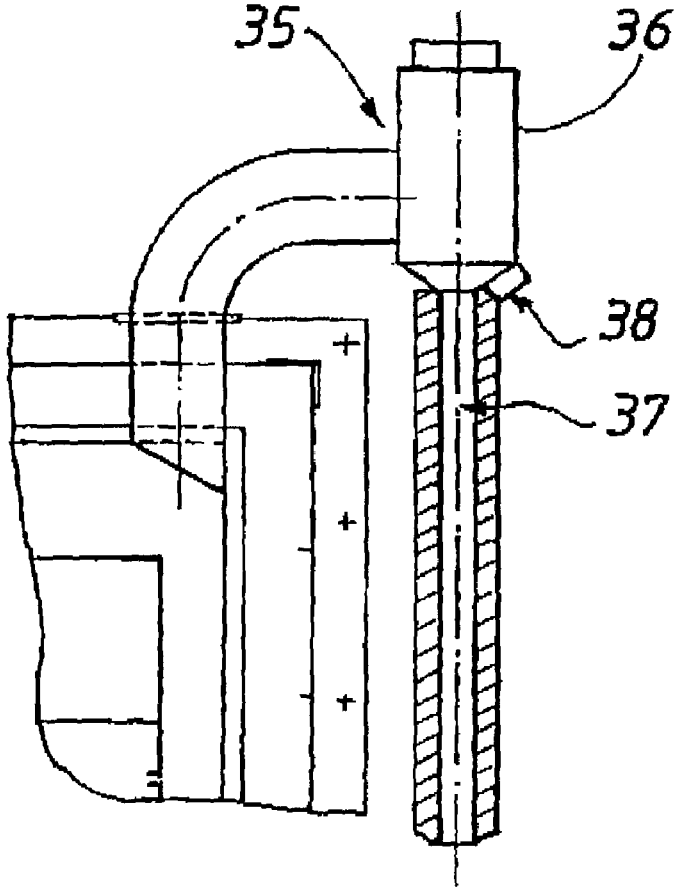
FIG. 5 PRIOR ART
FIG. 5 is a cross-sectional view on a larger scale of a chimney of the apparatus in FIG. 1.
Figure 6:
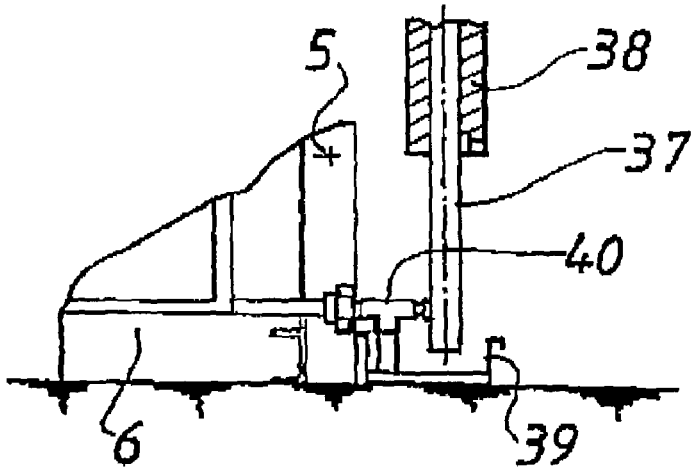
FIG. 6 PRIOR ART
FIG. 6 is a cross-sectional view on a larger scale of a bubble chamber of the apparatus in FIG. 1.

Various constructional features, details of which follow, can also be provided. The openwork side panels 8 and 9 can be constituted by horizontal members, adjustable in height so as to be able to provide larger or smaller gaps between them. One thus ensures homogeneous distribution of gas flow in the treatment chamber by providing smaller openings at the top of the openwork side panels 8, 9 compared to those at the bottom. As shown in FIG. 5, the chimneys 34 can be provided with tar extractors, in the form of a condenser 36, the condensed tars flowing downwardly from the condenser 36 into a vertical pipe 37 heated by a heating element 38. This prevents tar-laden gases being discharged into the atmosphere. At its lower end, pipe 37 discharges into a bubble trap 39 shown in FIG. 6. The bubble trap recovers the tars flowing in the pipe at 37. Also, via pipe 40, it receives tars flowing on the floor of the treatment chamber. The end of pipe 40 terminates at the bottom of bubble trap 39 to avoid exchange of gas, via pipe 40, between the outside environment and the treatment chamber.

Additionally, inside the treatment chamber, lines of water injectors are provided in order to avoid any danger of fire. The use of such lines of water injectors makes it possible to quickly cool the lignocellulosic material inside the cell, should ignition occur. This limits the risks of accidental fire. Advantageously, one can provide for these lines of water injectors to be supplied from a water reservoir located at the top of the treatment apparatus, and controlled by solenoid valves supplied with electricity from an independently-fed inverter; this makes it possible to compensate for a complete power failure or a lack of water supply, by keeping a security device ready on standby.

Temperature sensors are provided in the cell, and these can be used, as explained below, for controlling treatment. A water supply is also provided in the combustion chamber 30, close to the burner, the use of which will be explained below.

The device permits effective and fast treatment of lignocellulosic material. The material is first loaded into the treatment apparatus. To achieve this, advantageously, trucks or trolleys of the type shown diagrammatically in FIG. 2 are used. Two meter long trucks, rendered integral with each other, which enter and leave the cell by a two-way chain driving mechanism with the drive means situated externally of the cell, can be used. Such a system has the advantage of readily being adaptable to the length of the treatment apparatus: it is indeed sufficient, if for example, two cells, a door and a base are assembled in order to form a 9-meter long treatment apparatus, to lengthen the truck drive chain by a corresponding amount.

The material to be treated is stacked on trolleys or trucks, with battens arranged between each layer so that, during treatment, gases can circulate inside the charge. For the cell dimensions given above, a capacity of some 6 to 10 cubic meters of the material to be treated, depending on thickness, can be achieved.

Next, a temperature sensor is arranged inside the charge. The temperature sensors of the cell thus comprise one or several fixed sensors mounted close to the openwork side panels 8 and 9, and, for example, four or eight sensors mounted in the corners of the cell. They also comprise one or several sensors mounted on a flying lead inside the treatment chamber, in order to be able to be arranged inside the charge. In an embodiment, three mobile sensors are used making it possible to measure the temperature inside the material, and four fixed sensors arranged on the walls of the treatment chamber.

Following this, the door of the apparatus is closed and treatment commences. For this, computer control can advantageously be provided, governed by the temperature measured by the fixed and mobile sensors, together with the degree of humidity measured by the humidity sensor or sensors.

Operation is based around the data measured by the sensors, taking account of various target parameters and the operation of the burner in the combustion chamber. The burner is designed to operate in a reducing atmosphere and ensures that the amount of oxygen in the combustion chamber always remains below a small percentage, for example some 3%. One can, for example, employ a Kromschroder™ burner model BIO 65 RG. 60 kW power is sufficient for the heat-treatment chamber dimensions given above. The burner is controlled by a solenoid valve which simultaneously controls flow of combustible gas, for example air and propane. The burner is additionally designed to be able to be re-ignited at any moment without pre-ventilation of the combustion chamber.

Figure 7:
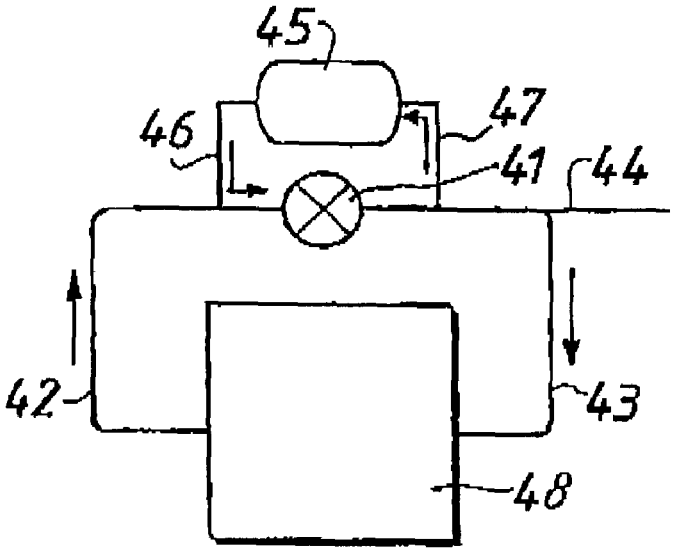
FIG.7 PRIOR ART
FIG. 7 is a diagram showing the circulation of gases in another prior-art apparatus.

FIG. 7 is a diagrammatical representation of the gas flow in the apparatus. Reference numeral 48 indicates the treatment chamber. Reference numeral 41 indicates the means for mixing the gases. As symbolized by line 42, the mixing means draw gases into the treatment chamber 44 by an induction conduit. They then discharge them through a delivery conduit, as shown symbolically by the line 43. Part of the gases can escape through chimney 44, which is located on the delivery conduit at the outlet end of mixing means 41. The gases of combustion chamber 45 are also mixed by the mixing means 41, in parallel with those of the treatment chamber. This is achieved by providing an induction branch 46 on induction conduit 42, which terminates at one side of the combustion chamber. Another delivery branch 47 on delivery conduit 43 terminates at another side of combustion chamber 45, thereby ensuring good circulation of the gases inside the latter.

In the embodiment of FIGS. 2–4, the delivery branch 47 terminates close to the burner in the combustion chamber. Arrangements could also be made for induction conduit 46 to terminate close to the burner. In the apparatus of FIG. 3, it is sufficient, for this, to arrange the burner at the other end of the combustion chamber, or to modify the position of the openings in the combustion chamber.

In both cases, a partial circulation of the treatment chamber gases through the combustion chamber is achieved, as explained below.

Figure 8:
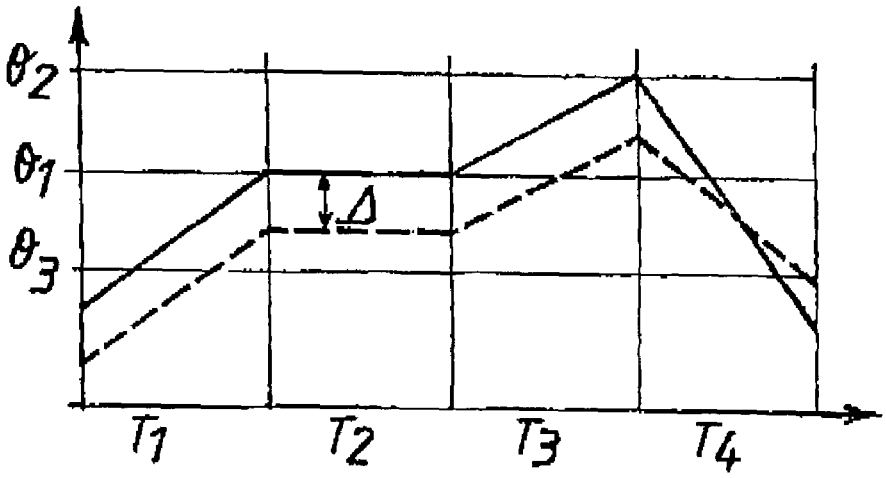
FIG.8 PRIOR ART
FIG. 8 is a diagram of temperature as a function of time during treatment according to the prior art.

FIG. 8 shows how temperature measured by the fixed sensors (continuous line) and the mobile sensors (dashed line) varies with time. As shown in FIG. 8, the treatment apparatus can be controlled automatically thanks to the temperature sensors by maintaining a substantially constant difference Δ between the mean temperature supplied by the fixed sensors and the mean temperature supplied by the mobile sensors. This difference is advantageously a function of the thickness of the material to be treated: Table 1 shows the temperature difference, in ° C., as a function of the thickness of the material loaded onto the truck or trolley.

TABLE 1

| Δ (°) | thickness (mm) |
|---|---|
| 5 | 5–10 |
| 10 | 11–15 |
| 15 | 16–20 |
| 20 | 21–40 |
| 30 | 41–60 |
| 40 | 61–90 |
| 50 | >90 |

Table 1 tabulates the wide range of thicknesses of material that can be treated thanks to the invention.

The first step in treatment consists in pre-heating the material up to a drying temperature $\theta_1$. This temperature is sufficient to ensure the free water contained in the material evaporates, and is for example comprised between 100° C. and 120° C., preferably around 105° C. The duration T1 of this pre-heating step depends on the thickness and nature of the material to be treated. It is easy to control the burner to provide a progressive increase in temperature, while maintaining the difference Δ substantially constant, as shown in FIG. 7. One could also use another method for controlling the build-up of temperature.

Once the drying temperature $\theta_1$ has been reached, drying of the material is performed by maintaining this same temperature value, or a temperature substantially close to this, until such time as all of the water contained in the material has practically all evaporated. During this drying step, just like during the pre-heating step, the mixing turbines ensure a portion of the gases originating from the treatment chamber circulates through the combustion chamber. This makes it possible to maintain the temperature in the treatment chamber, by supplying, by means of the burner, the energy necessary to vaporize the free water. Operating the burner in a reducing atmosphere ensures that the material treated does not catch fire, even if it is brought up to a high temperature. During drying of the material, the burner is controlled as a function of the temperatures measured. The humidity in the extraction chimneys is also measured. The next step can be initiated when the free water content in the material has been practically all evaporated, for example when the degree of humidity at the chimneys is comprised between 10% and 20%, preferably 12%. This value is sufficient to ensure that subsequent treatment of the material proceeds correctly, and it is not essential, nor useful, to attempt to achieve more complete evaporation.

The duration T2 of the drying phase further depends on the nature of the material to be treated, on the quantity of free water that it contains as well as the dimensions of the material. The duration can be zero where the material is very dry at the outset, the free water then being evaporated during the pre-heating step.

Next, a step in which dried material is heated is performed by raising the temperature up to a target value $\theta_2$. This temperature again depends on the nature of the material to be treated, and is typically comprised between 200° C. and 240° C. It can be close to 220° C. for certain foliaceous species, such as chestnut or close to 230° C. for resinous woods, such as Douglas pine. The temperature rise can again be controlled using the temperatures measured by the fixed and mobile sensors; in this case, the duration T3 of this heating step is not determined in advance, but again depends on the nature of the material, its thickness, and on the charge inside the treatment chamber. During this step, the extraction chimneys remain open, to ensure that the residual water vapor and burned gases are discharged. The degree of oxygen inside the treatment apparatus is limited, so the burner is operating in a reducing atmosphere. Additionally, the heated material gives off a combustible mixture, which is burnt in the combustion chamber. One avoids thereby any danger of the material catching fire.

At the end of this heating step, it can be arranged to maintain the material at the target temperature value $\theta_2$; this is not essential to obtain the mechanical strength results one normally looks for in high temperature treatment, but it can make it possible to obtain a given coloring of the material.

Following this, the material is cooled. For this, using the burner, water is sprayed into the combustion chamber. The effect of this is to decrease the temperature in the treatment chamber without this creating any thermal shock. Additionally, this ensures more homogeneous cooling of the material than would be the case if one were to spray the water directly into the treatment chamber. Cooling is continued until the temperature inside the material, measured by a mobile sensor or sensors, is lower than a third temperature $\theta_3$, limiting the risk of the material catching fire upon leaving the treatment chamber. In practice, a temperature of around 80° C. is sufficient. During the whole of this cooling step, the extraction chimneys give off water vapor. A throughput of a quarter of a liter of water every 15 seconds provides effective cooling for the cell dimensions given above. From the moment where the temperature $\theta_3$ within the material has dropped to around 120° C., cooling is continued without injecting water vapor, by simply mixing the gases within the treatment chamber. During the cooling step, the temperature within the material to be treated becomes higher than the outside temperature, as shown on FIG. 8. Cooling can be controlled simply by controlling the amount of water injected.

To take the example of the treatment of wooden planks of 120×27 mm cross section in a foliaceous wood such as oak, the following parameters can be employed:

$\theta_1$=120° C.; $\theta_2$=220° C.; $\theta_3$=100° C.; $\Delta$=20 to 40° C.

Treatment is carried out with the following durations:

T1=5 to 8 hours; T2=1 to 4 hours; T3=2 to 6 hours; T4=15–45 minutes For treating 120×27 mm cross-section planks in wood such as Douglas pine, the following parameters can be employed:

$\theta_1$=120° C.; $\theta_2$=230° C.; $\theta_3$=80° C.; $\Delta$=20° C. to 30° C.

Treatment is performed with the following durations:

T1=4 to 7 hours; T2=2 to 3 hours; T3=1 to 5 hours; T4=15-45 minutes Having described the prior art, the embodiments of the present invention will now be described.

Figure 9:
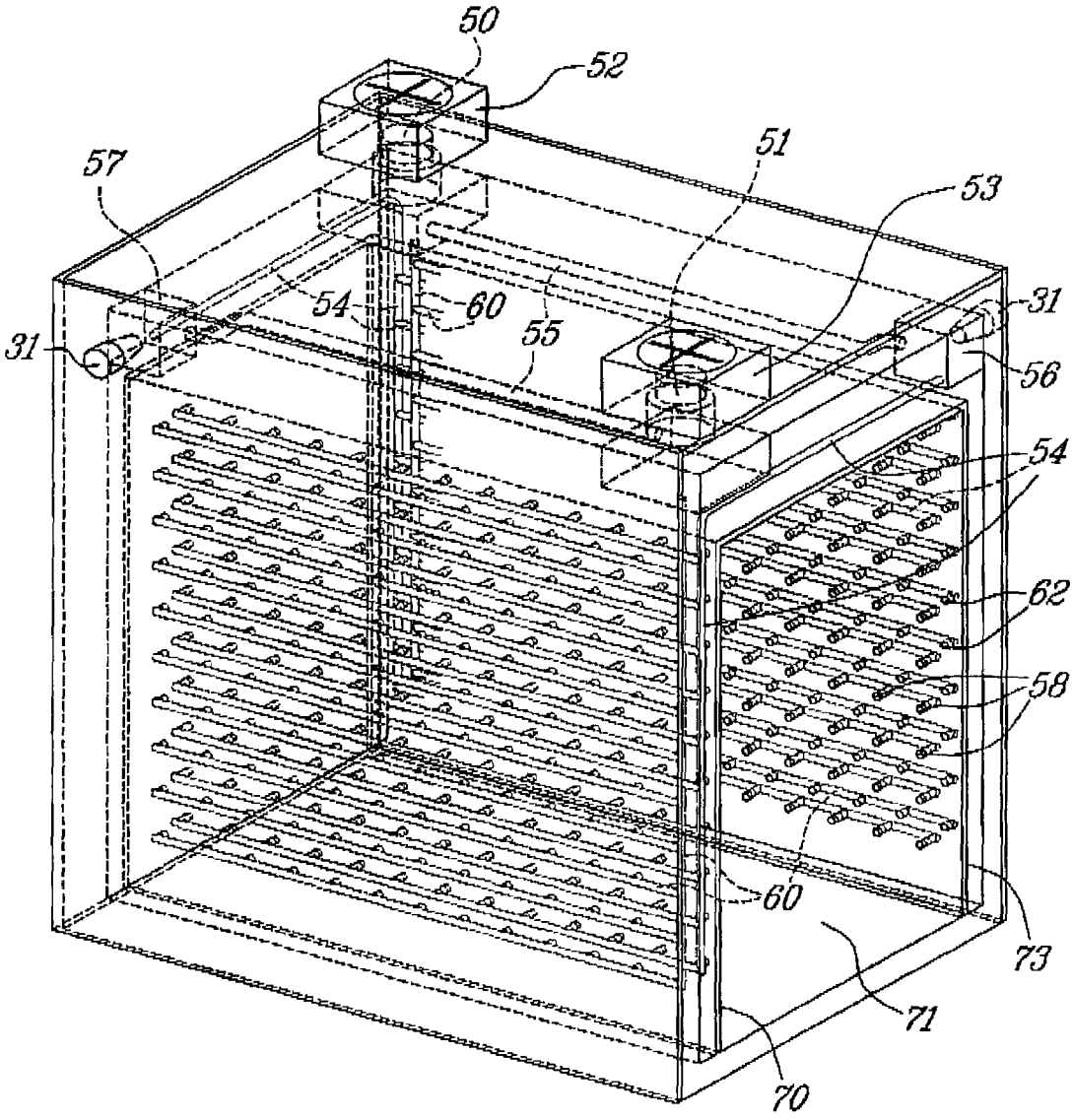
FIG. 9 is perspective view of an embodiment of the apparatus in accordance with the present invention.

In one embodiment of the invention, there is provided an apparatus suitable for high temperature treatment of lignoceliulosic material. Some of the features of the apparatus described in respect of the prior art noted above are present in the apparatus of the invention, but additional and novel features, which improve the gas circulation within the treatment chamber, are provided. FIG. 9 is a perspective view of the apparatus in accordance with an embodiment of the invention. It will be appreciated that the apparatus also has a door as described in FIG. 1. The overall circulation of the gases is controlled by turbines 50 and 51 located in turbine chambers 52 and 53. The turbines 50 and 51 circulate the gases to gas delivery devices shown in the examples as delivery ducts 54 and nozzles 58. The turbine chambers 52, 53 are connected in fluid communication with combustion chambers 56 and 57 through conduits 55, to deliver gases, having been heated in the combustion chamber, to at least two walls 70, 73 of the treatment chamber 71. In the combustion chambers, the gases are circulated in close proximity to or within the flame, produced by burner 31, to be heated to a desired temperature. The delivery ducts 54 are connected to the treatment chamber by nozzles 58.

Also provided are gas recovery arrangements which include recirculation ducts 60 and channels 62 defining a plurality of gas intakes as shown in FIGS. 9, 10, 11 and 12. The gas recovery arrangements are also linked to the walls of the treatment chamber to recover and recirculate the gases that have been injected in the treatment chamber. The recirculation ducts 60 are connected to the turbine chambers 52 and 53 to complete the circulation loop. The recirculation ducts are connected to the treatment chamber by channels (intakes) 62. Advantageously, this arrangement permits a bidirectional circulation of the gases within the treatment chamber to provide a uniform temperature across the treatment chamber and, consequently, a more homogeneous temperature exposure for the lignocellulosic material being treated. As a result, the material can be dried more efficiently. The provision for bidirectional flow results in high energy efficiency and maximum gaseous exposure to the greatest possible surface area of the material to be treated.

It will appreciated that the gas delivery and recovery may be provided on the front and the back sides of the treatment chamber instead of the left and right sides. It will be further appreciated that the gas delivery and recovery may be provided on more than two sides of the treatment chamber, provided that a uniform flow of gas is achieved within the chamber.

Figure 10:
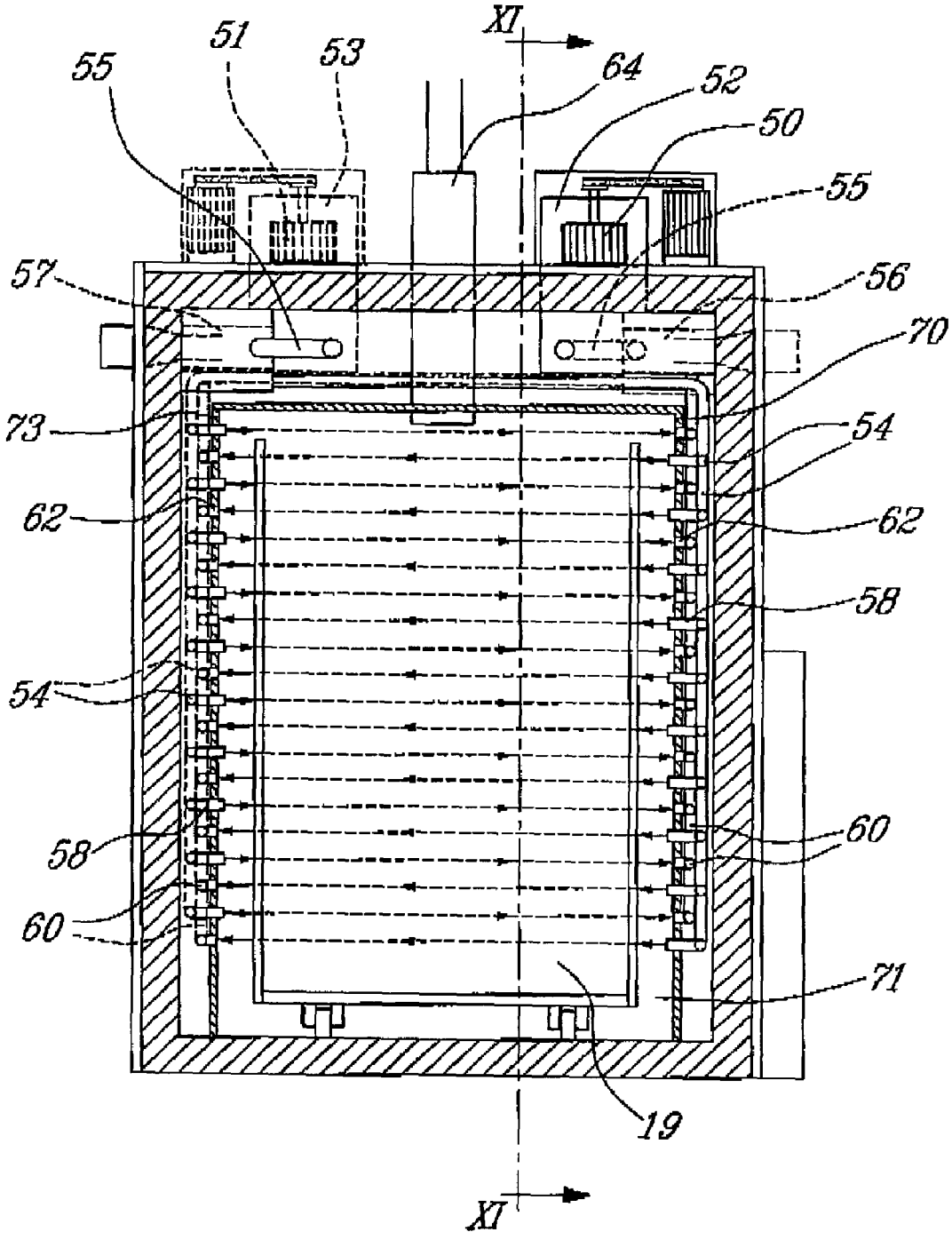
FIG. 10 is a cross-sectional view of an embodiment of the apparatus of FIG. 9.

Referring now to FIG. 10, which is a cross-sectional view of the apparatus, the flow of the gases within the chamber is further illustrated. The material to be treated is shown at 19 and is supported by a truck or trolley. Delivery ducts 54 are shown on each sides of the chamber and are connected with the interior of the treatment chamber by nozzles 58. Also shown are recirculation ducts 60 and channels 62. The nozzles 58 are preferably arranged in horizontal rows that alternate with rows of channels 62. Furthermore, a row of nozzles on one side of the treatment chamber is preferably located at substantially the same height as a row of channels on the opposite side. Rows of nozzles and channels span substantially the entire height of the walls of the treatment chamber. This arrangement advantageously optimize the flow of gases from one side to the other. It will be appreciated however, that other patterns of nozzles/channels can be used to achieve gas circulation in both directions within the treatment chamber. Also shown in FIG. 10 is extraction chimney 64 which is connected to the treatment chamber.

Figure 11:
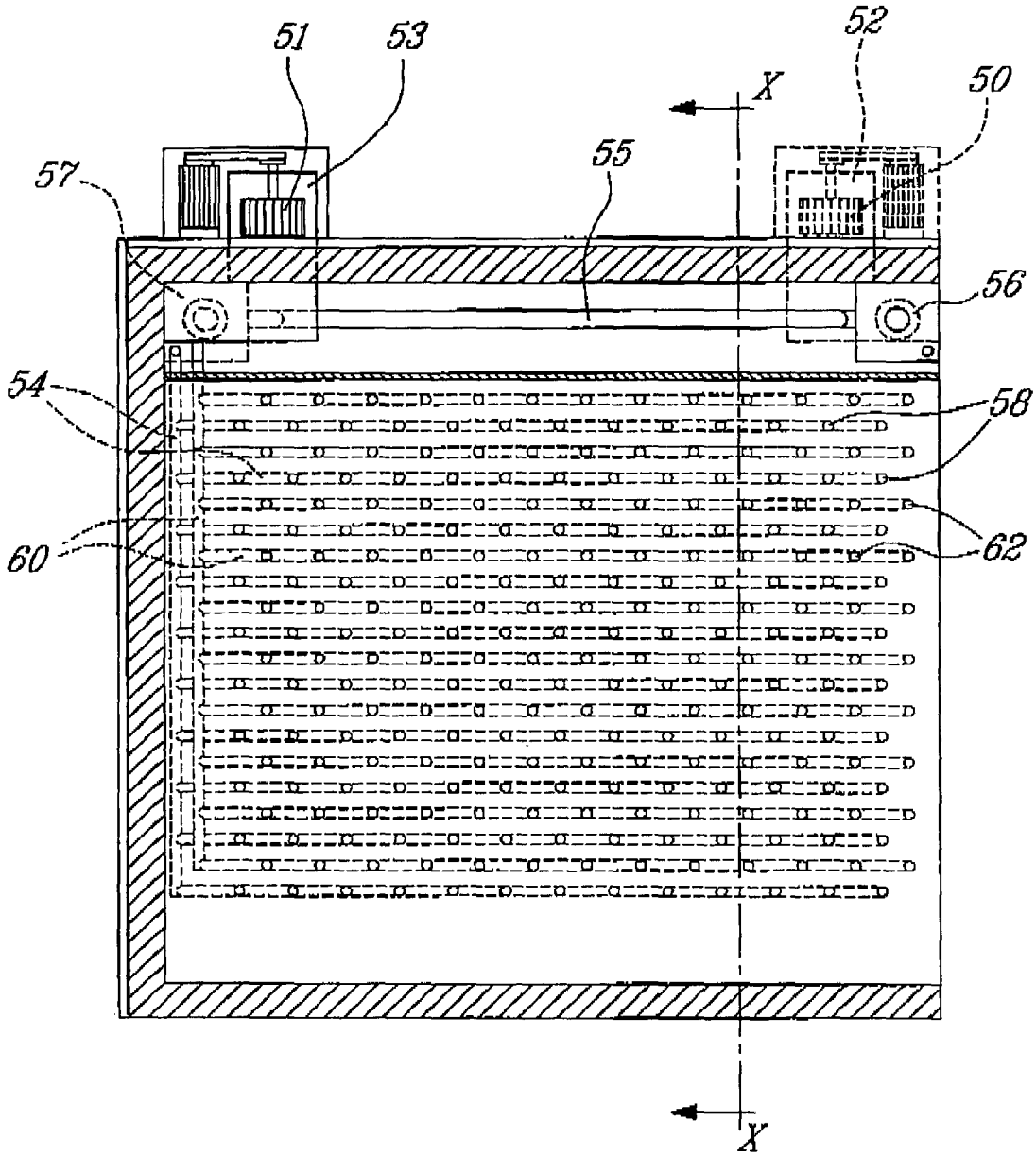
FIG. 11 is a longitudinal cross-sectional view taken along the plane II—II as indicated in FIG. 10.

A longitudinal cross-section taken along the plane XI—XI as indicated in FIG. 10 is shown in FIG. 11 in which the plane shown in FIG. 10 is shown as X—X. The turbine chambers and the combustion chambers are located at each extremity of the apparatus and are linked through a section of the delivery duct 54.

Figure 12:
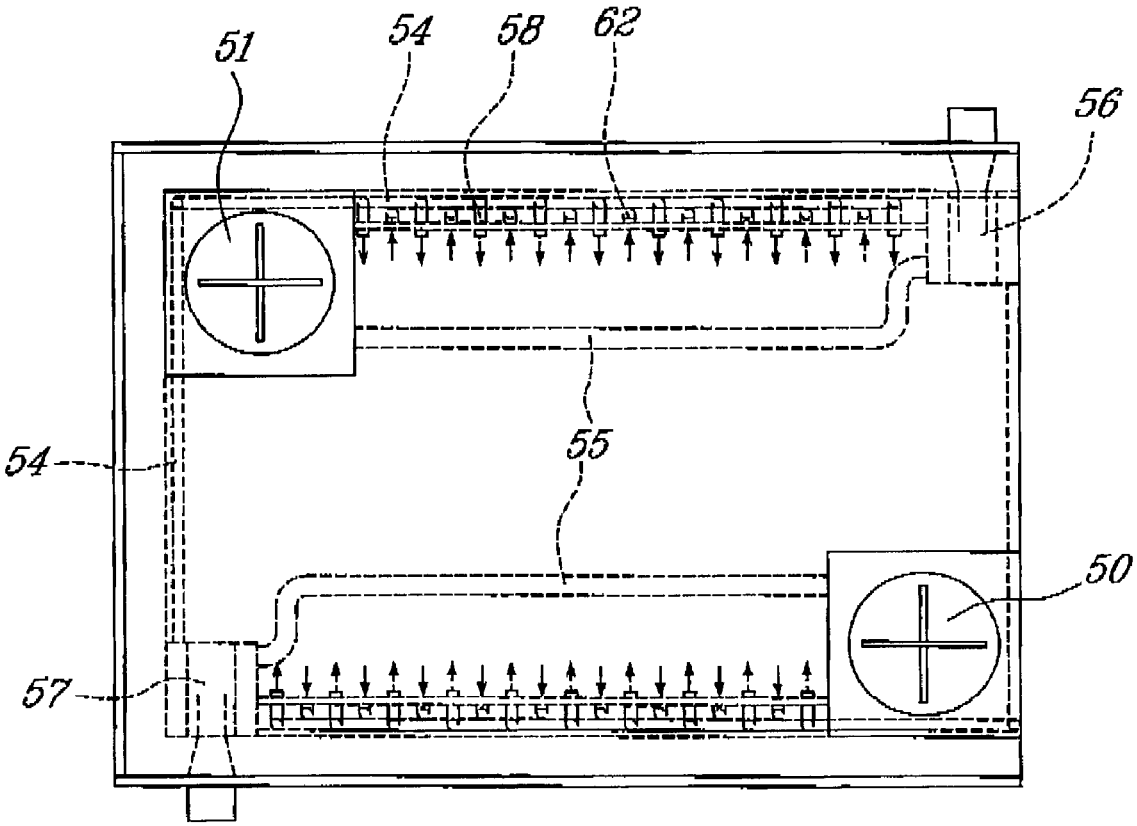
FIG. 12 is a top view of an embodiment of the apparatus of FIG. 9 in accordance with the invention.

FIG. 12 is a top view showing the arrangement of the turbines and the combustion chambers. As can be seen the turbines 50 and 51 are preferably located at each end of the apparatus and at opposite corners and the combustion chambers are located in the other two corners.

It will be appreciated that different arrangements of the turbine chambers and combustion chambers may also be provided to achieve substantially the same result of delivering to and recovering from opposite sides of the treatment chamber. For example, only one turbine may be provided to circulate the gases through the delivery channels on both sides. Similarly a single combustion chamber may be provided and linked to the turbine chambers.

Water inlets (not shown on the Figures) may also be provided for pulverizing water within the treatment chamber for cooling the material after it has been treated. In this respect, water lines may be provided that are connected to the treatment chamber by sprinklers.

In another feature of the invention, a method is provided for circulating gas in the treatment chamber for achieving a substantially uniform temperature within the treatment chamber and the lignocellulosic material being treated. In accordance with the method, the gases are heated and delivered circulated to the treatment chamber by at least two sides such as to provide a flow along two directions with the treatment chamber. Thus, substantially the entire surface of the lignocellulosic material receives the same quantity of heat energy. The method significantly reduces the power required to achieve a minimal temperature within the material and the chamber resulting in substantial economy. The method further comprises the evacuation of the gases from the two opposite sides of the treatment chamber. The gases are then circulated through a combustion chamber to be heated. Residual heat may be recovered by suitable means known to those skilled in the art in order to reduce the addition of heat and therefore enhance the process economics.

In a further aspect of the method, the material inside the treatment chamber is cooled off as part of the treatment. In a preferred embodiment, the temperature is lowered by pulverizing water, aqueous solutions, or any other fluid, compatible with the treatment and the material, having a relatively high heat capacity, within the chamber. In this regard, the fluid may be augmented with a suitable additive useful in the treatment of the material. As explained above the water can be introduced in the chamber by water lines and sprinklers that can be automatically controlled.

In another embodiment the lowering of the temperature within the treatment chamber may be achieved by cooling the gases by, inter alia, passive radiation, diffusion, cooling fluids and heat sinks as would be well known to persons skilled in the art. The recovered heat may be reused in the heating of the gases during treatment or for other purposes in the process.

The invention makes it possible to treat lignocellulosic material completely automatically, in a simple fashion. Circulation of gases originating from the treatment chamber through the combustion chamber along with operation of the burner in a reducing atmosphere, makes it possible to simplify the structure of the apparatus.

Obviously, the invention is not limited to the embodiments described by way of example. One can thus vary the number and nature of the circulating devices as well as the number and nature of the burners.

For measuring the temperature externally of the material, one or several temperature sensors could be used arranged other than in the treatment chamber, for example in the delivery and recirculation ducts. For measuring the temperature inside the material, one can use, as proposed above, a mobile sensor. Other means are possible, such as for example a probe.

The embodiment(s) of the invention described above is (are) intended to be exemplary only. The scope of the invention is therefore intended to be limited solely by the scope of the appended claims.

We claim:

1. An apparatus for high-temperature heat treatment of lignocellulosic material, the apparatus comprising:

a treatment chamber into which a lignocellulosic material can be placed for heat treatment;

a combustion chamber for heating gas, the combustion chamber being in fluid communication with the treatment chamber; and means for circulating the gas from the combustion chamber into the treatment chamber, wherein the treatment chamber includes opposed, generally upright side walls, each side wall having both a plurality of nozzles for discharging gas into the treatment chamber and a plurality of intakes for recovering the gas.

2. The apparatus as claimed in claim 1 wherein the nozzles and intakes are arrayed in alternating rows.

3. The apparatus as claimed in claim 2 wherein a row of nozzles on a first side wall is aligned directly across from a row of intakes on a second, opposed side wall.

4. The apparatus as claimed in claim 1 wherein the means for circulating the gas comprises at least one turbine.

5. The apparatus as claimed in claim 4 wherein the means for circulating the gas comprises a pair of turbines mounted in turbine chambers that are disposed above the treatment chamber.

6. The apparatus as claimed in claim 1 wherein the treatment chamber defines a generally box-shaped enclosure whereby the opposed side walls are vertical and parallel to each other.

7. The apparatus as claimed in claim 2 wherein the alternating rows of nozzles and intakes are aligned horizontally and wherein the rows of intakes are horizontally offset from the rows of nozzles.

8. The apparatus as claimed in claim 1 wherein each side wall of the treatment chamber further comprises:

a plurality of parallel, horizontal delivery ducts for delivering heated gas to the nozzles; and a plurality of parallel, horizontal recirculation ducts for recirculating recovered gas from the intakes.

9. The apparatus as claimed in claim 8 wherein the plurality of horizontal delivery ducts are in fluid communication with a vertical delivery duct on each side wall whereas the plurality of horizontal recirculation ducts are in fluid communication with a vertical recirculation duct disposed on the same side wall.

10. A method of treating a lignocellulosic material in a high-temperature treatment chamber, the method comprising the steps of:

loading the lignocellulosic material into the high-temperature treatment chamber;

heating a gas for circulation into the treatment chamber;

discharging the gas into the treatment chamber through both opposed, generally upright side walls of the treatment chamber; and recovering the gas from the treatment chamber through both of the side walls of the treatment chamber.

11. The method as claimed in claim 10 wherein the discharging step comprises discharging gas into the treatment chamber via a plurality of nozzles and wherein the recovering step comprises drawing gas from the treatment chamber via a plurality of intakes.

12. The method as claimed in claim 10 further comprising the step of recirculating the gas recovered from the treatment chamber into a combustion chamber for reheating of the gas.

13. The method as claimed in claim 10 wherein the heating step comprises a step of combusting fuel in a combustion chamber in fluid communication with the treatment chamber, whereby the fuel burns in a reducing atmosphere.

14. The method as claimed in claim 10 further comprising the step of injecting a fluid into the treatment chamber to cool the lignocellulosic material after treatment.

15. The method as claimed in claim 10 further comprising the step of extracting waste gas through an extraction chimney.

16. An apparatus for high-temperature heat treatment of lignocellulosic material, the apparatus comprising:

a treatment chamber into which a lignocellulosic material can be placed for heat treatment;

a combustion chamber for heating gas, the combustion chamber being in fluid communication with the treatment chamber; and means for circulating the gas from the combustion chamber into the treatment chamber, wherein the treatment chamber includes opposed, generally upright side walls, each side wall having a plurality of nozzles for discharging gas into the treatment chamber and a plurality of intakes for recovering the gas from the treatment chamber, the nozzles and intakes being vertically and horizontally arrayed in a pattern over the side walls.

17. The apparatus as claimed in claim 16 wherein each of the side walls has alternating rows of nozzles and intakes.

* * * * *